United States Patent [19]

Musso

[11] Patent Number: 4,601,596

[45] Date of Patent: Jul. 22, 1986

[54] TYPING AND ERASING DEVICE FOR PRINTING MACHINES

[75] Inventor: Pietro Musso, Ivrea, Italy

[73] Assignee: Ing. C. Olivetti & C., S.p.A., Ivrea, Italy

[21] Appl. No.: 586,967

[22] Filed: Mar. 7, 1984

[30] Foreign Application Priority Data

Mar. 7, 1983 [IT] Italy ..... 67255 A/83

[51] Int. Cl.[4] ..... B41J 33/34; B41J 33/14

[52] U.S. Cl. ..... 400/697.1; 400/214

[58] Field of Search ..... 400/697.1, 214, 213, 400/211, 213.1, 262

[56] References Cited

U.S. PATENT DOCUMENTS

| | | | |
|---|---|---|---|
| 4,022,313 | 5/1977 | Lau et al. | 400/213.1 |
| 4,111,293 | 9/1978 | Kockler et al. | 400/213 |
| 4,141,662 | 2/1979 | Hepper et al. | 400/213 |
| 4,172,672 | 10/1979 | Oddicini et al. | 400/697.1 |
| 4,353,657 | 10/1982 | Schaefer | 400/213 |
| 4,411,541 | 10/1983 | Mansfeld et al. | 400/697.1 |
| 4,436,192 | 3/1984 | Longrod | 400/214 |
| 4,472,073 | 9/1984 | Valle et al. | 400/697.1 |

FOREIGN PATENT DOCUMENTS

| | | | |
|---|---|---|---|
| 2825948 | 12/1979 | Fed. Rep. of Germany | 400/213.1 |
| 12891 | 1/1982 | Japan | 400/697.1 |
| 133090 | 8/1982 | Japan | 400/697.1 |
| 138682 | 8/1983 | Japan | 400/697.1 |
| 183279 | 10/1983 | Japan | 400/697.1 |
| 9085 | 1/1984 | Japan | 400/213.1 |

*Primary Examiner*—William Pieprz

*Attorney, Agent, or Firm*—Banner, Birch, McKie & Beckett

[57] ABSTRACT

The typing and erasing device is applied to a printer of the daisywheel type and comprises a carrier (84, 86) for a typing ribbon (32) having a plurality of transverse tracks which can be selected for the printing operation and a carrier for an erasing ribbon which is disposed parallel to but at a different height from the typing ribbon. The typing ribbon is contained in a cartridge on which two typing ribbon carrier arms (41) are pivoted. The carriers oscillate vertically in order to render visible the typed characters and for the operations of typing or erasing the characters at the typing point (12). A cam (81) for actuating the typing ribbon, which is controlled by a control shaft (56) selectively and successively positions the various tracks of the typing ribbon, and a second actuating cam (61) positions the correction ribbon independently of the position of the typing ribbon by way of a cam-follower pin (126) and a lever (127) which actuates the correction ribbon carrier and also the correction ribbon feed mechanism. The second cam (61) has interconnected tracks (122, 123, 124) such that selection of the correction ribbon is effected only in response to one direction of movement of the control shaft. The second cam (61) also actuates a lever (63) of the typing ribbon-feed mechanism. The cam (81) is three-lobed and rotates 120° for each complete rotation of the control shaft (56) and second cam (61) fixed thereto.

9 Claims, 8 Drawing Figures

TYPING AND ERASING DEVICE FOR PRINTING MACHINES

The present invention relates to a typing and erasing device for printing machines, in particular of electronic type.

A typing and erasing device in electronic typewriters is known wherein a cam is disposed on a drive shaft and has four grooved profiles which are disposed symmetrically in pairs and which are capable of operating on a pin on a cam follower lever which positions a typing ribbon of the machine, at the point of typing. A second lever is arranged to be moved by the cam follower lever and guides the erasing ribbon towards the point of typing. The typing ribbon has two typing regions or tracks in order to make use of the entire height of the ribbon. If the cam with its grooved profiles is rotated in an anticlockwise direction, the cam follower lever is alternately guided by the first or the second grooved profile and lifts the typing ribbon, positioning the first or the second track of the ribbon in front of the point of typing, without altering the position of the correction ribbon. If an erasing cycle is to be performed, the cam is rotated in the clockwise direction and the pin lifts both the cam follower lever which guides the typing ribbon and the erasing ribbon guide lever, positioning the erasing ribbon in front of the point of typing and the typing ribbon well above the point of typing. That arrangement is reliable but it is not able to position more than two regions of the typing ribbon since, for a greater number of such regions, the even greater lift required in respect of the erasing ribbon would be found to be unacceptable.

The object of the present invention is therefore to provide a typing and erasing device which is of moderate cost, reliable and very easy to use and which makes it possible to employ a typing ribbon having more than two tracks which can be selected for the typing operation.

This object is achieved by the device according to the present invention, which is characterised by the characterising portion of the main claim.

Figure 1:
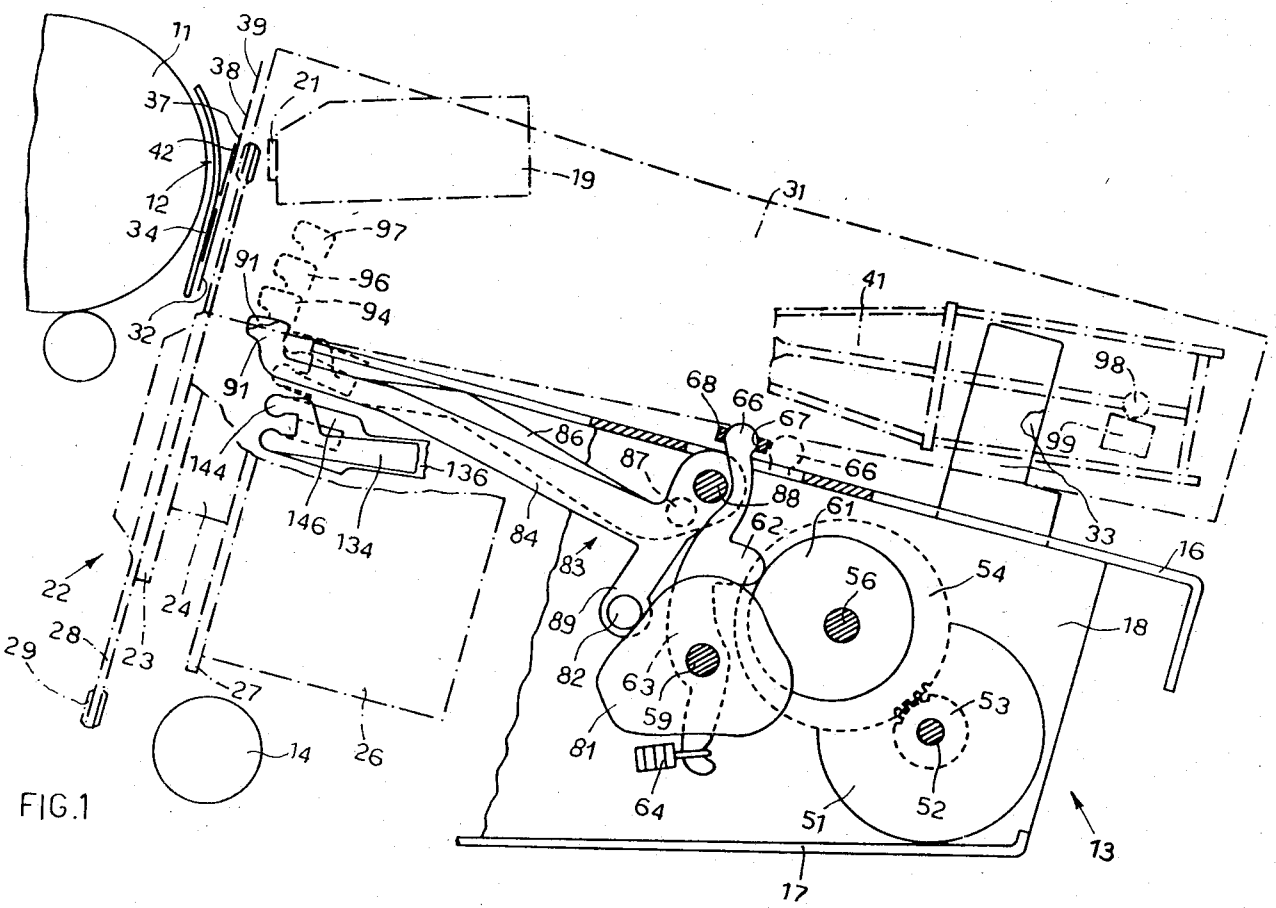
Figure 7:
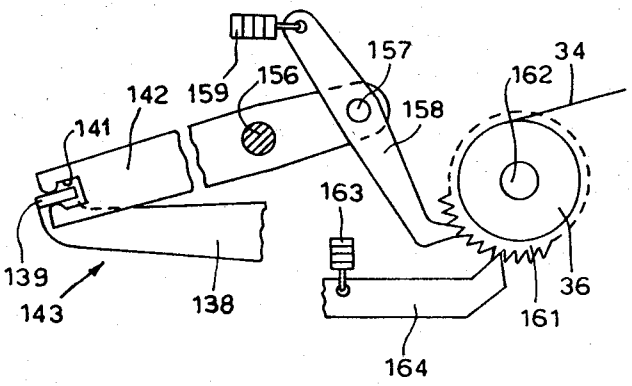
Figure 2:
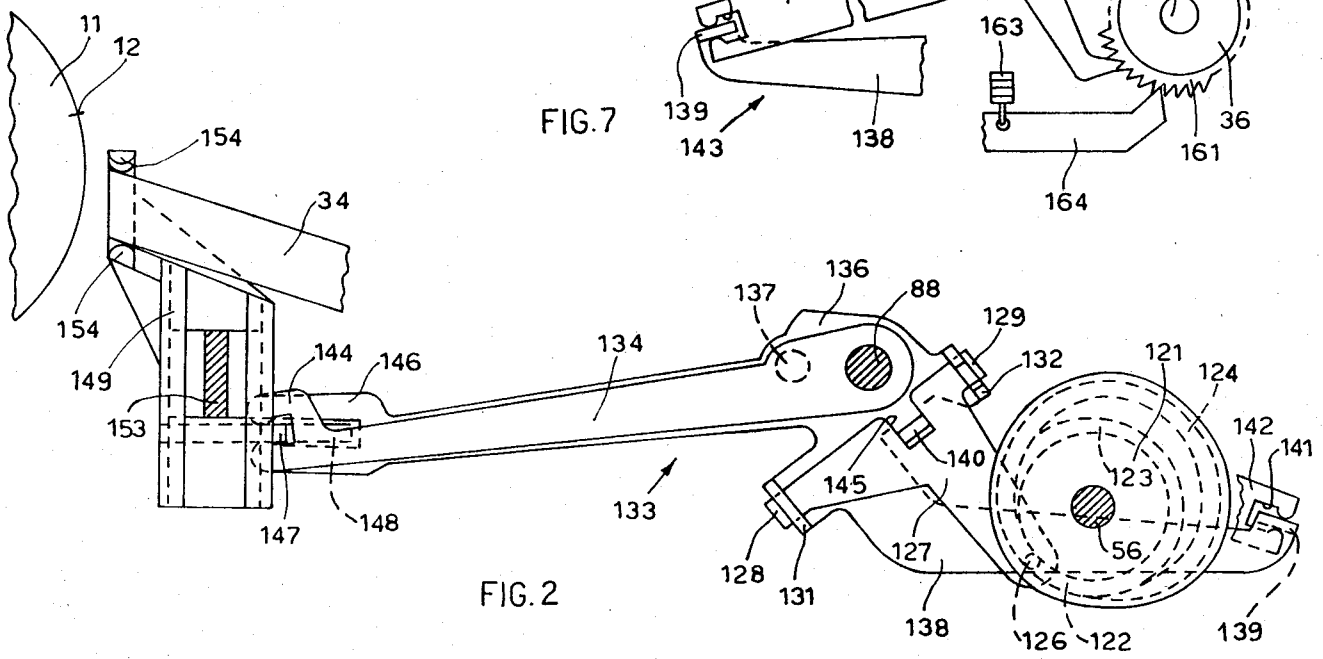
Figure 3:
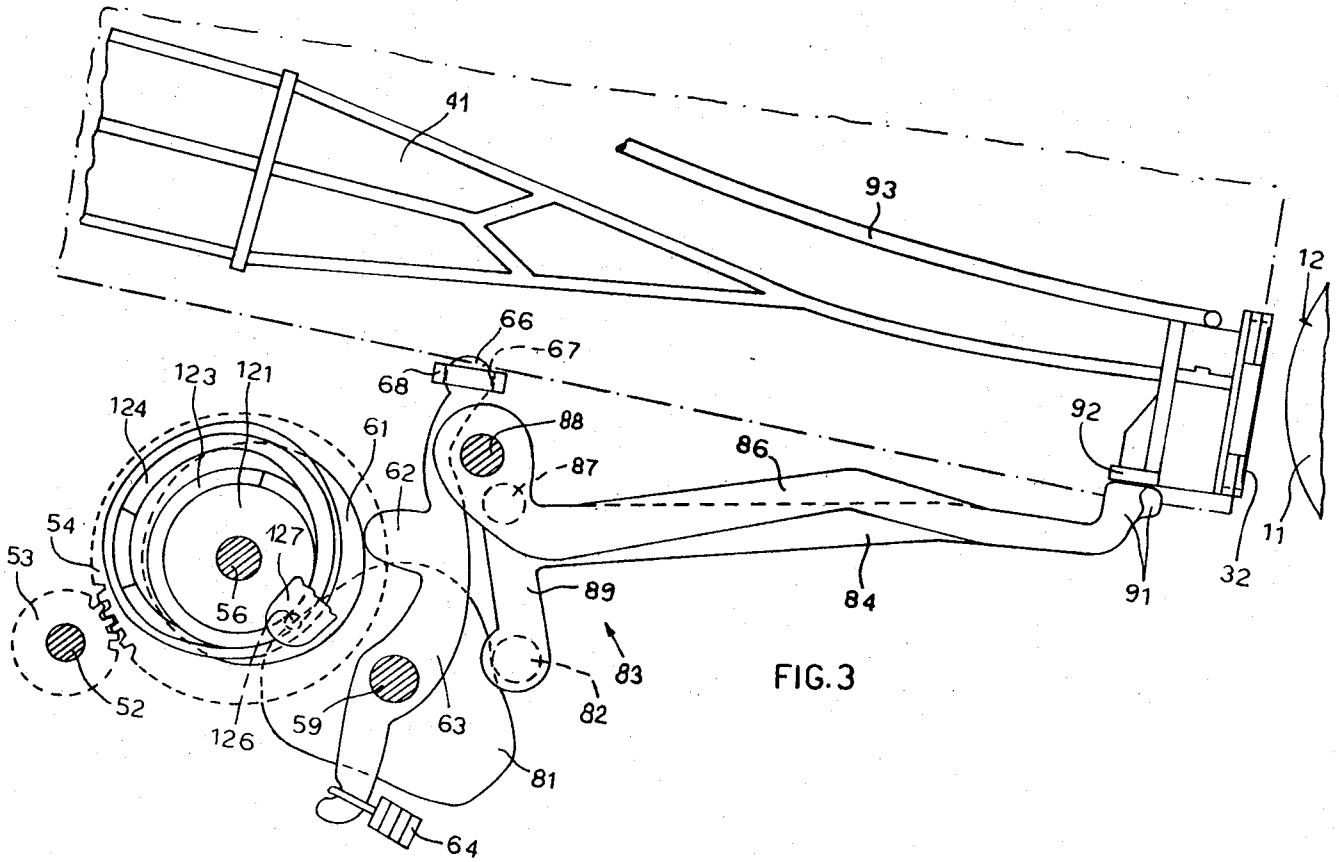
Figure 4:
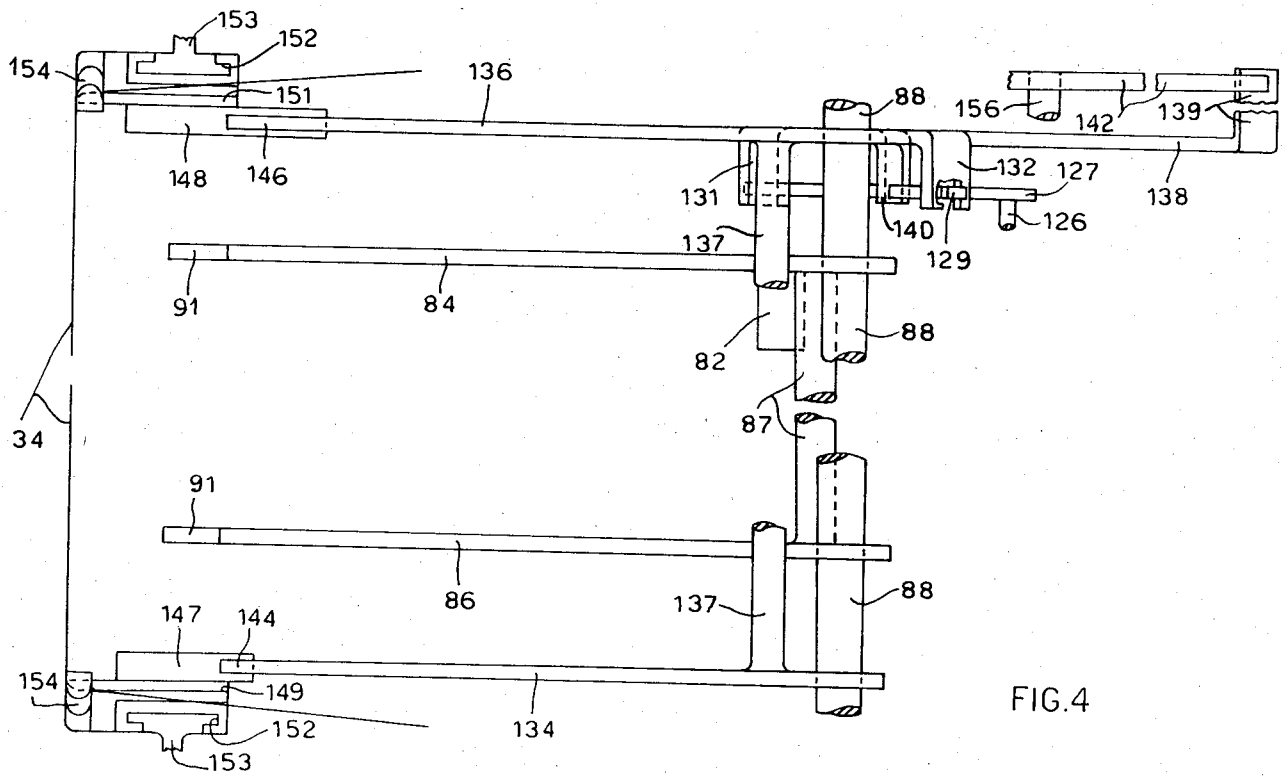
Figure 5:
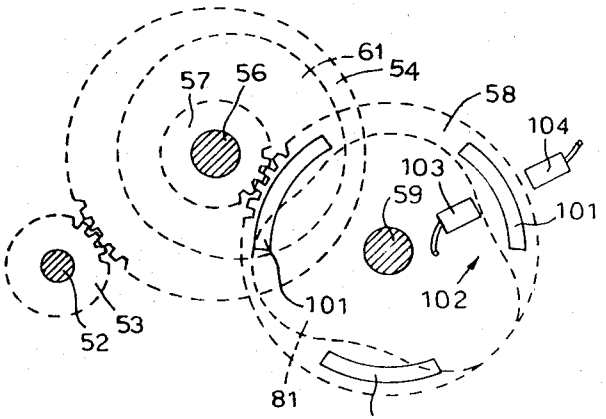
Figure 6:
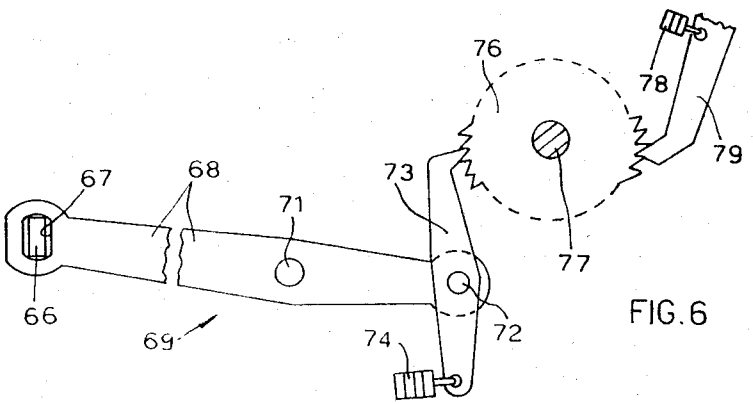
Figure 8:
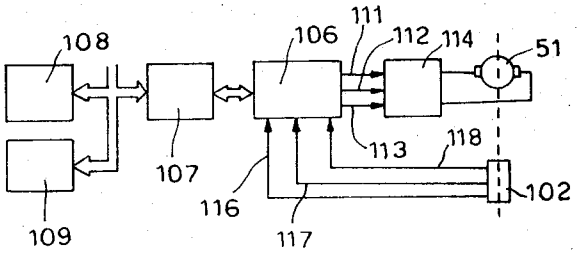

A preferred embodiment of the invention is set forth in the following description which is given by way of non-limiting example and with reference to the accompanying drawings in which:

FIG. 1 shows a first partial longitudinal section of a typewriter,

FIG. 2 shows a second partial longitudinal section of the machine shown in FIG. 1, on an enlarged scale, FIG. 3 shows a third partial longitudinal section of the machine shown in FIG. 1, on an enlarged scale, FIG. 4 shows a plan view of part of the machine shown in FIGS. 1, 2 and 3, on an enlarged scale, FIG. 5 shows a fourth partial longitudinal section of the machine shown in FIG. 1, on an enlarged scale, FIG. 6 shows a plan view of part of the mechanism for forward feed movement of the typing ribbon of the machine shown in FIG. 1, on an enlarged scale, FIG. 7 shows a plan view of part of the mechanism for forward feed movement of the erasing ribbon of the machine shown in FIG. 1, on an enlarged scale, and FIG. 8 shows a logic block circuit diagram of a control and regulating unit of the machine shown in FIGS. 1, 2 and 3.

In the embodiment described hereinafter, the typing and erasing device for printing or typing machines comprises a platen roller 11 (see FIG. 1) on which the point of typing or printing is indicated by reference numeral 12, and a carriage which is indicated generally by reference numeral 13 and which is movable transversely to the platen roller 11 along a guide 14. The carriage 13 is slidable on the guide 14 in both directions, for example by means of a reversible electrical stepping motor which is not shown in the drawings and which is as described in the U.S. Pat. No. 3,707,214. The carriage 13 comprises a base portion 16 having a bottom plate 17 connected by means of side portions 18 (only one of which is shown in the drawings) to the base portion 16. A solenoid 19 carries a hammer 21 for co-operating with a character carrying disc indicated generally at 22. The character carrying disc or daisywheel 22 is fixed to a flange 23 on a disc selector shaft 24 and is rotatable by means of an electric motor 26 which is fixed to an upright 27 of the carriage 13. The character carrying disc 22 comprises a slotted peripheral rim portion providing flexible blades 28. Each blade 28 carries at one end thereof a corresponding typing or printing character 29. The characters 29 are selected by means of the motor 26 in known manner, for example as described in the U.S. Pat. No. 3,983,985.

The carriage 13 carries a cartridge 31 for a printing or typing ribbon 32, by means of lateral guides 33, and two spools on which a correction or erasing ribbon 34 is wound (only one spool 36 can be seen in the drawings in FIG. 7). The typing ribbon 32 (see FIG. 1) has a plurality of transverse tracks which can be selected for the typing or printing operation, thereby to use the entire height of the ribbon. In FIG. 1, the ribbon 32 is shown entirely in the rest position and with only the upper edge in the three operating positions which are respectively indicated by 37, 38 and 39. The cartridge 31 is of the type having two lateral arms, each having an arm 41 movable from a rest position shown in FIG. 3 to three successive operating positions, as described hereinafter, for positioning the ribbon 32 (see FIG. 1) in the three operating positions 37, 38 and 39. The erasing ribbon 34 is movable from a rest position in which it is parallel to the ribbon 32 and permits the point of typing 12 to be viewed, to an operating position indicated at 42, in which it is in front of the point of typing 12.

An electric motor 51 which is designed to rotate selectively in the clockwise and the anticlockwise directions comprises a shaft 52 on which a pinion 53 is fixed. The pinion 53 is always in mesh with a gear 54 on a shaft 56. The transmission ratio between the pinion 53 and the gear 54 is 3 to 1. The gear 54 (see FIG. 5) is fixed by means of the shaft 56 to a pinion 57 which in turn is engaged with a gear 58 on a shaft 59. In that connection also, the transmission ratio between the pinion 57 and the gear 58 is 3 to 1, whereby a rotary movement of 360° of the shaft 56 corresponds to a rotary movement of the shaft 59 through 120°.

A cam 61 is fixed on the shaft 56 and co-operates with a projecting lug 62 (see FIG. 1) on a lever 63 for controlling the forward feed movement of the ribbon 32.

In particular, the lever 63 is pivotally mounted on the shaft 59 and, under the force of a spring 64, is normally rotated in a clockwise direction with the projecting lug 62 bearing against the cam 61. The lever 63 has an end 66 which is housed in a seat 67 in a lever 68 (see FIG. 6) of a pawl mechanism generally indicated by reference numeral 69, for the forward feed movement of the ribbon 32. The pawl mechanism 69 comprises the lever 68 which is rotatable on a shaft 71 and having a pin 72 on which a pawl 73 is pivotally mounted. A spring 74 holds the pawl 73 rotated in a clockwise direction and in engagement with a sawtooth wheel 76. The sawtooth wheel 76 is rotatable with a shaft 77 for controlling the forward feed movement of the typing ribbon 32 of the cartridge 31 in per se known manner which is not shown in the drawings. A spring 78 holds a reverse motion pawl 79 normally engaged with the teeth of the sawtooth wheel 76 to prevent rotary movement of the wheel 76 in the reverse direction, which is undesired. Fixed on the shaft 59 (see FIG. 1) is a member for actuating the typing ribbon, comprising a cam 81 having three lobes which have three different lifts and which are disposed at 120° relative to each other and which are arranged to co-operate with a pin 82 on a carrier frame for the typing ribbon, as generally indicated by reference numeral 83. The frame 83 comprises two arms 84 and 86 which are fixed with respect to each other by means of a shaft 87 and which are rotatable on a shaft 88. The lever 84 has an arm 89 to which the pin 82 is fixed. Each lever 84 and 86 has an end 91 capable of co-operating with a shoulder 92 (see FIG. 3) on the respective arm 41. A spring 93 holds the respective arm 41 normally engaged with the shoulder 92 against the corresponding end 91. The cam 81 also has three zones of minimum lift, which are disposed adjacent to the lobes and which define three corresponding rest positions, or positions in which the ribbon 32 permits typing to be seen.

In each typing or printing cycle, as described hereinafter, the three-lobe cam 81 positions the carrier frame 83 with the respective ends 91 from the rest position which is shown in solid lines in FIG. 1 and in which the point of typing 12 can be seen, to the successive operating positions 94, 96 and 97 corresponding to lifting and operational positioning of the ribbon 32 in the positions 37, 38 and 39 respectively. For that purpose, the two movable arms 41 of the cartridge 31 oscillate vertically by means of pins 98 pivoted on fixed carriers 99 of the cartridge 31.

The three-lobe cam 81 (see FIG. 5) is fixed with respect to the gear 58 which also carries three sector portions 101 which are disposed at 120° relative to each other. A transducer 102 comprising a photodetector 103 and a lighting means 104 which are disposed on opposite sides with respect to the path of movement of the sector portions 101 signals the passage of the sector portions 101, to an input-output unit 106 (see FIG. 8), and the positions reached by the three-lobe cam 81 (see FIG. 5).

The typing and correction device is applied to a machine of the type described in the U.S. Pat. No. 4,500,216 comprising the input-output unit 106 (see FIG. 8) controlled by a central unit 107 connected to memories 108 and to a keyboard 109 . The input-output unit 106 controls clockwise and anticlockwise rotation and stopping of the motor 51 by means of three lines 111, 112 and 113 and an amplifier 114 and receives information in respect of the angular positions of the three-lobe cam 81 from the transducer 102 by way of the lines 116, 117 and 118. In particular, when the typing ribbon is in the viewing position, one of the sector portions 101 screens the photo detector 102 from the light produced by the lighting means 104.

The cam 61 is fixed with respect to the gear 54 and a control member 121 (see FIG. 2), which is substantially similar to that described in U.S. Pat. No. 4,472,073, and is therefore not described in detail herein, comprising a common profile 122 connected to a circular profile 123 and to an eccentric profile 124 in such a way as to form two grooved profiles which are interconnected to each other. The profiles 123 and 124 are arranged to receive a pin 126 on an actuating lever 127. The profiles 123 and 124 are delimited by a step and an inclined surface portion, whereby one of the two profiles 123 and 124 can be engaged by the pin 126, in dependence on the direction of rotation of the shaft 56.

The actuating lever 127 comprises two appendages 128 and 129 which are received in suitable seats in lug portions 131 and 132 respectively of a frame structure 133. The frame structure 133 comprises two levers 134 and 136 which are fixed relative to each other by means of a shaft 137 and are rotatable on the shaft 88. The lever 136 comprises the two portions 131 and 132 and an arm 138 having a projecting lug portion 139 co-operable with a U-shaped fork portion 141 of a lever 142 of a pawl mechanism generally indicated by reference numeral 143 (see FIG. 7) for the forward feed movement of the erasing ribbon 34. The lever 136 also comprises a lug portion 140 housed in a slot 145 in the lever 127. The levers 134 (see FIG. 2) and 136 terminate with U-shaped fork portions 144 and 146 respectively which are co-operable with respective lug portions 147 and 148 on two correction ribbon guide elements 149 and 151 respectively (see FIG. 4). Each element 149 and 151 comprises a T-shaped slot 152 for housing a fixed guide 153 on the base portion 16 (see FIG. 1) and a C-shaped fork portion 154 which projects towards one side, for guiding the erasing ribbon 34 parallel to the roller 11.

The pawl mechanism 143 (see FIG. 7) comprises the lever 142 which is rotatable on a shaft 156, having a pin 157 on which a pawl 158 is pivotally mounted. A spring 159 urges the pawl 158 in an anticlockwise direction and holds it engaged with a sawtooth wheel 161 on which the spool 36 of the erasing ribbon 34 is mounted. The wheel 161 is rotatable on a shaft 162. A spring 163 holds a reverse motion pawl 164 normally engaged with the teeth of the sawtooth wheel 161 to prevent rotation in the reverse direction, which is thus undesired, of the wheel 161.

If the motor 51 (see FIG. 1) causes the control member 121 (see FIG. 2) to rotate in a clockwise direction through a cycle of 360°, the pin 126 is guided first by the side walls of the common profile 122 and subsequently by the side walls of the circular profile 123, while it cannot enter the profile 124 because it is separated by the step. The angular position of the lever 138 does not vary and therefore also the actuating lever 127 remains in its rest position together with the frame structure 133 and the erasing ribbon 34.

If the motor 51 (see FIG. 1) causes the control member 121 (see FIG. 2) to rotate in an anticlockwise direction through a cycle of 360°, the pin 126 is guided firstly by the side wall portions of the common profile 122 and subsequently by the wall portions of the eccentric profile 124, while it cannot enter the profile 123 because of the corresponding step. The profile 124 now moves the actuating lever 127 which consequently causes the frame structure 133 to rotate in a clockwise direction about the shaft 88, and the U-shaped fork portions 144 and 146 cause the respective correction ribbon guide elements 149 and 151 (see FIG. 4) to slide in the corresponding fixed guides 153 to position the erasing ribbon 34 in front of the point of typing 12 (see FIG. 1) in the position 42 shown in FIG. 1.

The pin 126 (see FIG. 2), sliding from the rest position in which it is disposed, moves the frame structure 133 in an anticlockwise direction, to the maximum extent when the member 121 has rotated through 180°. The erasing ribbon 34 goes from the rest position in which the point of typing 12 can be viewed, to the raised position 42 (see FIG. 1) in front of the point of typing 12. That fact is also signalled by the photodetector 102 which is no longer screened by the sector portion 101.

During the lifting movement, the pawl mechanism 143 (see FIG. 7) is actuated by the arm 138. In fact, the arm 138 with the lug portion 139 causes the lever 142 to rotate in the anticlockwise direction and the pawl 158 moves over the teeth of the wheel 161, engaging a space following that in which it was previously engaged. When the erasing ribbon 34 is positioned in front of the point of typing 12 (see FIG. 2), the control member 121 is arrested and the correction strike is made. The control member 121 is then rotated from 180° to 0°, moving the pin 126 into a position of engaging the common profile 122. It will be clear that the grooved profiles 122 and 124 always positively control the pin 126 to prevent oscillatory movement during correction of the characters, with respect to the point of typing 12. During that movement of the member 121 from the 180° position to the 0° position, the control lever 127 causes the carrier frame structure 133 to rotate in an anticlockwise direction, whereby the erasing ribbon 34 goes from the raised position 42 (see FIG. 1) to the down position. At the same time, the arm 138 (see FIG. 7) with the lug portion 139 causes the lever 142 to rotate in the clockwise direction, which lever 142, with the pawl mechanism 158, causes anticlockwise rotation of the wheel 161 together with the spool 36, causing the erasing ribbon 34 to advance by a step which is equal to or greater than the space intended for a character. The three-lobe cam 81 (see FIG. 1) can assume three angular positions 0°-120°-240° and printing or typing is effected by sequentially using three tracks 37, 38 and 39 disposed at three different levels on the ribbon 32. After each character has been printed, the ribbon 32 is advanced over a length equal to one third of the space intended for a single character, by means of the pawl mechanism 69 (see FIG. 6). If the motor 51 (see FIG. 1) rotates the control member 121 (see FIG. 2) in a clockwise direction through 360°, the three-lobe cam 81 (see FIG. 1) is rotated in an anticlockwise direction through 120°, being connected to the control member 121 by means of the gear 58 (see FIG. 5) and the pinion 57. As described hereinbefore, the pin 126 (see FIG. 2) is guided by the circular profile 123 so that its angular position does not change and, with the control lever 127, it remains in its rest position. The cam 61 (see FIG. 1) which is fixed with respect to the shaft 56 will be rotated through 360° whereby, after about 135°, it permits the lever 63 to rotate in the clockwise direction, due to the force of the spring 64, thereby moving the end 66 from the position shown in solid line to the position shown in broken line. With the movement, the end 66 (see FIG. 6) causes the lever 68 to rotate in the clockwise direction, moving the pawl 73 over the teeth of the wheel 76.

The cam 61 (see FIG. 5) continues to rotate and from about 225° to about 315°, moves the lever 63 (see FIG. 1) back into its rest position. During that movement, the lever 68 (see FIG. 6) rotates in the anticlockwise direction with the pawl 73 which, being engaged with a tooth on the wheel 76, rotates the wheel 76 and advances the ribbon 32. At the same time, the three-lobe cam 81 (see FIG. 1), after 35° of rotation, rotates the carrier frame structure 83 in a clockwise direction, whereby the ends 91 of the levers 84 and 86 engage the shoulders 92 (see FIG. 3), lifting the arms 41 against the force of the springs 93. The ends 91 move into the position 94 (see FIG. 1) and thus the typing ribbon is positioned in position 37 in front of the point of typing 12. The three-lobe cam 81 remains, from 35° to 85°, in the position in which the ribbon 32 is in position 37. That situation is signalled to the unit 107 by the photodetector 102. At about 60° of rotation of the three-lobe cam 81, the motor 51 is temporarily stopped and the character to be printed is struck by means of the hammer 21 and the solenoid 19. After about 10.4 ms from the strike, the unit 107 re-activates the motor 51 which rotates the cam 81 from 85° to 112° approximately and permits the carrier frame structure 83 to return to the rest condition. The typing ribbon 32 is lowered and again permits the typed character to become visible. The three-lobe cam 81 is now in the 120°-rotated position. Printing of another character causes the cam to rotate through a further 120° whereby the ribbon 32 is moved into position 38 for a cycle similar to that described hereinbefore, still to return to the rest position, and then goes to the 360°-0° position whereby the typing ribbon 32 is moved into position 39 and is then returned yet again to the rest position.

Since the three-lobe cam 81 has three angular rest positions at 0°, 120° and 240°, each corresponding to a zero position of the member 121, each of those angular positions of the three-lobe cam 81 can be a starting position for an erasing cycle.

If the motor 51 rotates the actuating member 121 (see FIG. 2) in an anticlockwise direction through a 360° cycle, at the same time as the correction ribbon 32 is raised and advanced, the three-lobe cam 81 (see FIG. 1) also rotates in an anticlockwise direction through a 120° cycle, being connected to the control member 121 by means of the gear 58 (FIG. 5) and the pinion 57 with a transmission ratio of 3 to 1. Therefore, if the three-lobe cam 81 is in the 0° position, it goes to the 240° position, if it is in the 240° position, it goes to the 120° position and if it is in the 120° position, it goes to the 0° position, and so on.

As described hereinbefore, with the rotary movement of the three-lobe cam 81, the frame structure 83 is rotated in the clockwise direction to move the typing ribbon into the positions 39, 38 and 37, in dependence on the angular positions of the three-lobe cam 81.

Therefore, the typing ribbon 32 being behind the erasing ribbon 34, the hammer 21, when it strikes a blade 28 to strike the character 29 against the platen roller 11, causes the character to be removed from the paper rather than causing it to be typed, while the character to be erased is typed on the back of the erasing ribbon 34.

During each erasing cycle, the pawl mechanism 69 (see FIG. 6) advances the typing ribbon 32 by one third of the space allocated to the character and the pawl mechanism 143 (see FIG. 7) advances the erasing ribbon 34 by a complete space. Erasure of a character is programmed by the memories 108 and the central unit 107 of the machine in such a way as to provide two repeated cycles of erasure of the same character, in the manner already described above, for more complete removal from the paper of the character to be erased.

In order to relocate a fresh portion of ribbon 32 in front of the point of typing 12, in the two erasing cycles, with a striking action, the machine causes a further rotary movement through 360° in the anticlockwise direction of the member 121, without activation of the hammer 21. After those cycles, the ribbon 32 will be advanced by a full space plus one third, while the last track previously used will be selected again.

It will be clear that the actuating member 121 (see FIG. 2), by rotating in the clockwise direction, engages the pin 126 with the circular profile 123, positively leaves the control lever 127 in the rest position, and prevents actuation of the erasing ribbon carrier frame structure 133, while the three-lobe cam 81 (see FIG. 1) selectively positions the typing ribbon in one of the three operating positions 37, 38 and 39.

If the actuating member 121 (see FIG. 2) rotates in an anticlockwise direction, the pin 126 engages the eccentric profile 124, and the control lever 127 causes rotary movement of the frame structure 133 to position the erasing ribbon 34 in the operating position 42, independently of the track selected on the ribbon 32.

I claim:

1. A typing and erasing device for printing machines of the type comprising a platen which defines a typing point; an electric motor having a motor shaft selectively rotatable in one or another direction by said motor; a typing ribbon having a plurality of tracks which can be selected for the printing of characters; a typing ribbon carrier cooperating with the typing ribbon and oscillatable for positioning a given area of each one of said plurality of tracks in front of the typing point; a rotatable actuating member having an active profile including a plurality of rest portions and a plurality of operative portions of different lift, wherein said active profile is operatively connected with the typing ribbon carrier upon rotation of said actuating member to reproduce in sequence oscillating movements of the typing ribbon carrier to cause in sequence viewing of the typing point and typing of characters through the given area of said plurality of tracks; a correcting ribbon for correction or deletion of typed characters; a correcting ribbon carrier cooperating with the correcting ribbon to dispose a given area of said correcting ribbon into a working position parallel and overposed to said given area of the typing ribbon and wherein said correcting ribbon carrier is actuatable for moving the given area of said correcting ribbon from a rest position wherein the correcting ribbon is away from the typing point to a working position wherein said given area of the correcting ribbon is in front of the typing point; a cam follower for actuating said correcting ribbon carrier; a rotatable control member comprising two cam profiles which have a common portion and are connected therebetween to be selectively engageable by said cam follower in dependence on the direction of rotation of said control member, wherein the engagement of one of the two cam profiles by said cam follower moves the correcting ribbon carrier for positioning the given area of the correcting ribbon in front of the typing point and wherein the engagement of said cam follower with another of the two cam profiles causes the correcting ribbon carrier to be held in the rest position with the correcting ribbon away from the typing point; wherein the other of the two cam profiles of the control member is of constant lift and the one of the two cam profiles is eccentric with respect to the other profile and said two cam profiles form two interconnected grooves, wherein the correcting ribbon carrier comprises an element housed in the common portion of the two cam profiles and which can engage the other profile of constant lift or the eccentric profile when the control member rotates in the clockwise direction or in the counterclockwise direction, respectively, and wherein a correcting ribbon feed mechanism is connected with the correcting ribbon carrier and feeds the correcting ribbon upon the movement of the correcting ribbon to its working position; synchronizing means connecting said motor shaft with said actuating member and said control member to synchronize the actuating member with the control member such that a complete rotation of said actuating member corresponds with a partial rotation of said control member causing the cooperation of said typing ribbon carrier with said active profile from one to another rest portion through one of said operative portions, wherein when the electric motor rotates the control member in said one direction the given area of said correcting ribbon is positioned into its working position independently of the selected track of the typing ribbon, and wherein when the electric motor rotates the control member in the other direction said correcting ribbon is held in its rest position while the actuating member moves the typing ribbon carrier for positioning in sequence the given area of said plurality of tracks of the typing ribbon in front of the typing point.

2. A typing and erasing device according to claim 1, wherein the synchronizing means comprise an intermediate shaft, a first gear and an intermediate pinion fixed on the intermediate shaft, a second gear, and a further shaft on which is fixed the actuating member and the second gear, wherein the first gear is always in mesh with a fixed pinion mounted on said motor shaft and wherein the transmission ratio between the fixed pinion of the motor shaft and the first gear of the intermediate shaft is 3 to 1; wherein the intermediate pinion is always in mesh with the second gear and the transmission ratio between the intermediate pinion and the second gear of the second shaft is 3 to 1; wherein said plurality of operative portions and rest portions of the actuating member comprise three lobes which have three different lifts and which are disposed at 120 degrees relative to each other and three rest profiles which have equal lifts and are disposed at 120 degrees relative to each other, wherein each of the three rest profiles is disposed between two lobes in such a way that said three lobes and three rest profiles produce said oscillating movements of the typing ribbon carrier, wherein each of the three lobes positions selectively an associated track of the plurality of tracks of said typing ribbon in front of the typing point, and wherein said complete rotation of the control member corresponds to a rotary movement of the actuating member through 120 degrees.

3. A typing and erasing device according to claim 2, wherein the actuating member controls a cycle of oscillation of the typing ribbon carrier every 120 degrees and wherein the control member can actuate an erasing cycle either before and after each typing cycle.

4. A typing and erasing device according to claim 2, further comprising a cam fixed on the intermediate shaft, and a typing ribbon feed mechanism connected to said cam for feeding the typing ribbon when the given area of said typing ribbon is moved from the rest position to the working position and vice versa.

5. A typing and erasing device according to claim 1, wherein a cartridge houses the typing ribbon and comprises two movable arms on which is guided an external portion of the typing ribbon, and wherein the two movable arms are connected with and moved by two elements of the typing ribbon carrier for positioning a track of the plurality of tracks in front of the typing point.

6. A typing and erasing device according to claim 1, wherein said device is applied to an electronic typewriter having a typing element of the type comprising a character carrying disc with flexible blades.

7. A typing and erasing device according to claim 1, further comprising a control electronic unit connected with an input-output unit for controlling the clockwise and counterclockwise rotations of the electric motor, and a transducer for generating signals associated with the angular positions of the actuating member to be sent to said input-output unit.

8. A typing and erasing device for printing mechanism of the type comprising a platen having a typing point; an electric motor having a motor shaft selectively actuatable for a clockwise and a counterclockwise rotation; a typing ribbon having three tracks which can be selected for the printing of characters; a typing ribbon carrier cooperating with the typing ribbon for positioning a given area of said three tracks in front of the typing point; a typing ribbon feed mechanism for advancing said typing ribbon past the typing point; an actuating member having three rest profiles and three lobes of different lift cooperating with the typing ribbon carrier to produce oscillating movements of the typing ribbon carrier to permit viewing of typed characters and typing of characters through said given area of the three tracks; a correcting ribbon having an active area disposed parallel to the given area of said typing ribbon; a correcting ribbon carrier cooperating with the correcting ribbon from a rest position wherein the correcting ribbon is away from the typing point to a working position wherein the active area of said correcting ribbon is in front of the typing point; a control member having a common cam profile and two different cam profiles connected with said common cam profile to be selectively engaged by said correcting ribbon carrier in dependence on the direction of rotation of said control member for positioning the active area of said correcting ribbon in front of the typing point upon one of said clockwise and counterclockwise rotations of said control member and to hold at rest said correcting ribbon upon the other of said clockwise and counterclockwise rotations of said control member; synchronizing means connecting said motor shaft with the actuating member and the control member; a control unit performing correcting cycles providing selection of said one sense of rotation of said control member and typing cycles providing selection of the other sense of rotation of said control member; wherein each typing cycle and correcting cycle includes a complete rotation of said control member and a 120 degrees rotation of said actuating member; wherein said control unit provides two of said correcting cycles for a complete deletion or correction of a typed character and further provides two further rotations of said control member through said other sense of rotation to permit said feed mechanism to select a fresh portion of said typing ribbon upon a first typing cycle following the complete deletion or correction of a typed character and wherein said feed mechanism comprises a cam profile synchronous with said control member and a cam follower reciprocated by said cam profile and operatively connected with a feed member for advancing said typing ribbon.

9. A typing and erasing device according to claim 8, further comprising a transducer connected with said control unit and synchronous with said actuating member to define the positions of said actuating member associated with the cooperation of said typing carrier with said three rest profiles.

* * * * *